US007980103B2

(12) United States Patent
Kim

(10) Patent No.: US 7,980,103 B2
(45) Date of Patent: Jul. 19, 2011

(54) DRUM WASHING MACHINE

(75) Inventor: Jae Mun Kim, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 1246 days.

(21) Appl. No.: 11/033,707

(22) Filed: Jan. 13, 2005

(65) Prior Publication Data

US 2005/0229643 A1 Oct. 20, 2005

(30) Foreign Application Priority Data

Apr. 20, 2004 (KR) ..... 10-2004-0027033

(51) Int. Cl.
*D06F 37/26* (2006.01)

(52) U.S. Cl. ..... 68/235 R

(58) Field of Classification Search ..... 68/235 R
See application file for complete search history.

(56) References Cited

U.S. PATENT DOCUMENTS

| | | | | |
|---|---|---|---|---|
| 3,436,934 | A | 4/1969 | Stilwell, Jr. | |
| 2003/0051515 | A1 | 3/2003 | Woo et al. | |
| 2004/0037640 | A1 * | 2/2004 | Kim et al. | 403/408.1 |

FOREIGN PATENT DOCUMENTS

| | | | |
|---|---|---|---|
| CN | 1782214 | A | 6/2006 |
| DE | 10248793 | * | 11/2003 |
| FR | 2646501 | A * | 4/1989 |
| GB | 2034707 | A * | 2/1979 |
| KR | 20-1999-0012987 | U | 4/1999 |
| KR | 10-2002-0042993 | A | 6/2002 |

* cited by examiner

*Primary Examiner* — Michael Barr

*Assistant Examiner* — Jason P Riggleman

(74) *Attorney, Agent, or Firm* — Birch, Stewart, Kolasch & Birch, LLP

(57) ABSTRACT

A drum washing machine having tub coupling structure includes a cabinet having a plurality of coupling holes each receiving a transit bolt on a rear surface thereof, a tub provided in the cabinet so as to store wash water therein and having a plurality of coupling members each coupled with the transit bolt on a rear surface thereof, and a condensing duct provided to be connected with a rear surface of the tub and having a through hole formed at a position corresponding to one of at least three coupling members of the tub so as to be communicated therewith, the through hole to which the transit bolt is inserted.

10 Claims, 5 Drawing Sheets

DRUM WASHING MACHINE

CROSS-REFERENCE TO RELATED APPLICATIONS

This application claims the benefit of Korean Application No. P2004-27033, filed on Apr. 20, 2004, which is hereby incorporated by reference as if fully set forth herein.

BACKGROUND OF THE INVENTION

1. Field of the Invention

The present invention relates to a drum washing machine, and more particularly, to a transit bolt coupling structure of a drum washer, enabling to prevent the tub provided in the washing machine from moving during transportation of the washing machine.

2. Discussion of the Related Art

In general, a drum washing machine is an apparatus for washing laundries by rotating a drum via a driving force of a motor when detergent, wash water, and laundries are inserted therein. The drum washing machine has advantages of preventing laundries from being damaged and from being entangled, as well as achieving a rub washing effect.

A drum washing machine of a related art will be described in detail referring to FIG. 1. FIG. 1 illustrates a component diagram showing components of a drum washing machine of a related art. Referring to FIG. 1, the drum washing machine includes a cabinet 1 having a laundry entrance provided on a front surface thereof for inserting and withdrawing laundries, a door 2 provided on the laundry chamber and being opened and closed, a tub 10 made of a plastic material and provided in the cabinet so as to store wash water, a drum 20 rotatably provided in the tub 10, and a motor 30 provided at a rear portion of the tub 10 and transmitting a driving force to the drum 20.

A drying duct 40 is provided at an upper part of the tub 10. A fan 42 and a drying heater 44 are provided in the drying duct 40 so as to create and circulate hot air. A first end of the drying duct 40 is communicated with a front portion of the tub 10.

A second end of the drying duct 40 is communicated with a first end of a condensing duct 50. A second end of the condensing duct 50 is communicated with a surface of the tub 10 so as to form a circulating passage together with the drying duct 40.

Meanwhile, the tub 10 includes a spring 31 provided at an upper part thereof and a damper 32 provided at a lower part thereof, so as to reduce vibration generated during washing.

The drum washing machine of the related art including the structure mentioned above may be damaged because the tub 10 is moved by the spring 31 and the damper 32 and hit against the cabinet when the washing machine is delivered from a warehouse or for delivery.

In other words, the tub 10 is not completely fixed on the cabinet 1 but is supported by the spring 31 and the damper 32, movably provided in a predetermined range, and remaining in the air. Therefore, the tub 10 hits against an inner surface of the cabinet 1 when the washing machine is shaken heavily during delivery.

Accordingly, in order to prevent the tub 10 from being moved when the drum washing machine is transported after being manufactured, a transit bolt 60 is inserted into a coupling hole 3 formed at a rear surface of the cabinet 1 and coupled with a coupling member 12 formed on a rear surface of the tub 10 so as to fix the tub 10 on the cabinet 1.

Meanwhile, in recent years, a drum washing machine is being developed enabling to smoothly flow dry air by coupling the condensing duct with a lower end of a rear surface of the tub and coupling the drying duct with a front surface of the tub such that the dry air drawn from the front surface of the tub is discharged to a rear side of the tub.

FIG. 2 illustrates a drum washing machine having a structure in which a condensing duct is coupled with a rear surface of a tub. As illustrated in FIG. 2, a drying duct 46 includes a first end coupled with a front side of the tub 16, and a second end having a fan 48 mounted thereat. A condensing duct 52 includes a first end coupled with a lower part of a rear surface of a tub 16, and a second end coupled with a portion of the dying duct 46, the portion having the fan 48 formed thereon. In this case, in order to save a space, the condensing duct 52 is mounted on a rear surface of the tub 16 so as to be connected therewith.

Accordingly, the hot air blown by the fan 48 is drawn into a front surface of the tub 16 through the drying duct 46 and then drawn into the condensing duct 52 through a lower end of a rear side of the tub 16 so as to flow back to the drying duct 46.

A problem is however generated from coupling the condensing duct with the rear surface of the tub. First, among other coupling members coupled with the transit bolt 60, a coupling member 18 provided at an upper side is covered by the condensing duct, and thus it is impossible to couple the transit bolt with the coupling member thereat.

Accordingly, in order to couple the transit bolt with the coupling member, the coupling member for the transit bolt on the rear surface of the tub is necessarily moved to another location. In this case, many problems are raised including a problem that a new mold for manufacturing the tub needs to be manufactured.

Second, there is a disadvantage that the tub is unequally supported even though a new mold is manufactured and the coupling member is moved to an outside of the condensing duct.

Particularly, when the transit bolt is coupled using only existing coupling members while leaving the coupling member covered by the condensing duct without being coupled with the transit bolt.

SUMMARY OF THE INVENTION

Accordingly, the present invention is directed to a drum washing machine having a condensing duct provided at a rear wall member of a tub that substantially obviates one or more problems due to limitations and disadvantages of the related art.

An object of the present invention is to provide a transit bolt coupling structure of a drum washing machine, the structure enabling to easily couple a transit bolt to all positions of an existing tub without changing the structure of the tub.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum washing machine includes a cabinet having a plurality of coupling holes each receiving a transit bolt on a rear surface thereof, a tub provided in the cabinet so as to store wash water therein and having a plurality of coupling members each coupled with the transit bolt on a rear surface thereof, and a condensing duct provided to be connected with a rear surface of the tub and having a through hole formed at a position corresponding to one of at least three coupling members of the tub so as to be communicated therewith, the through hole to which the transit bolt is inserted.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
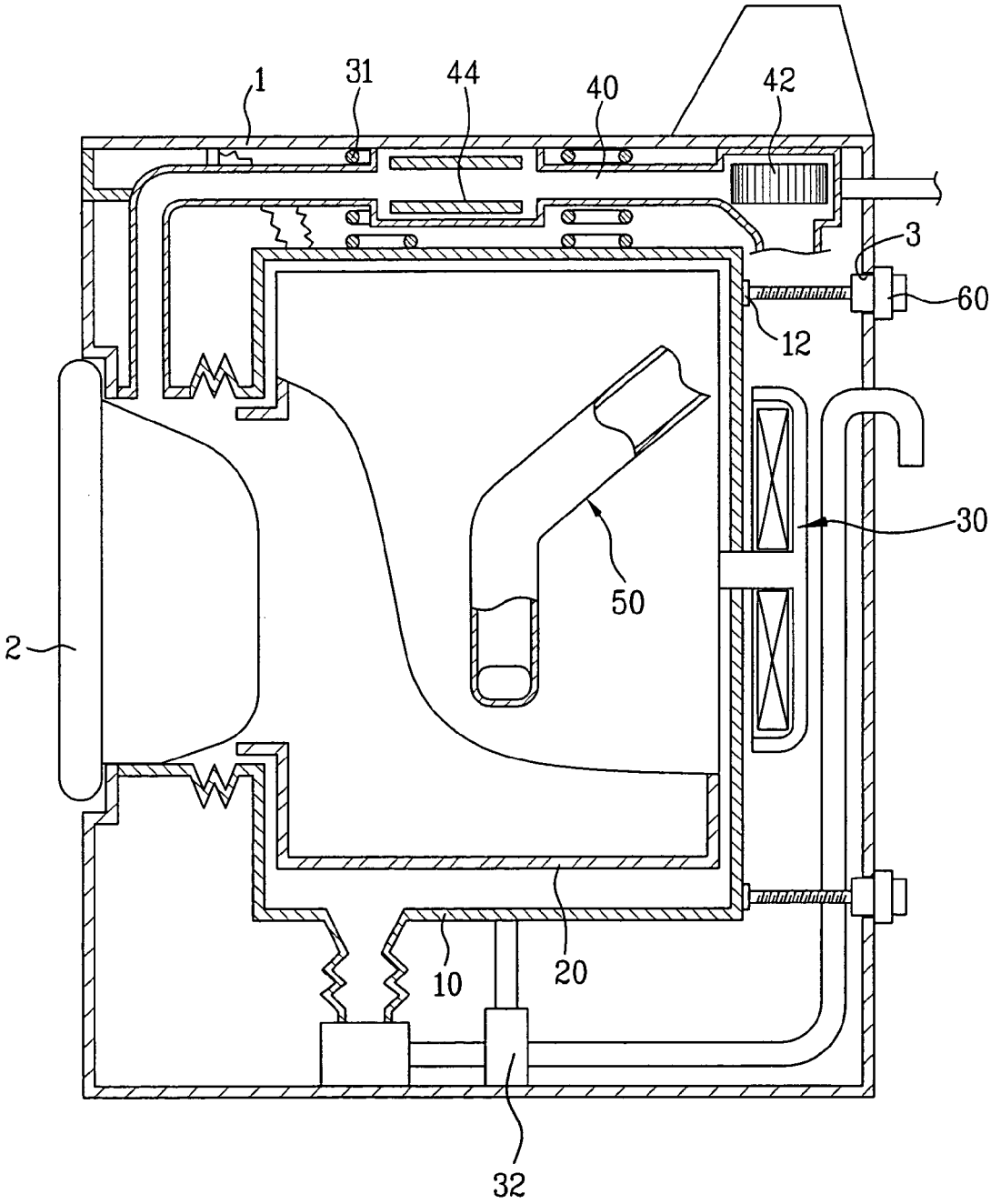
FIG. 1 Related Art
FIG. 1 illustrates a schematic cross sectional view showing a first embodiment of a structure of a drum washing machine of related art.
Figure 2:
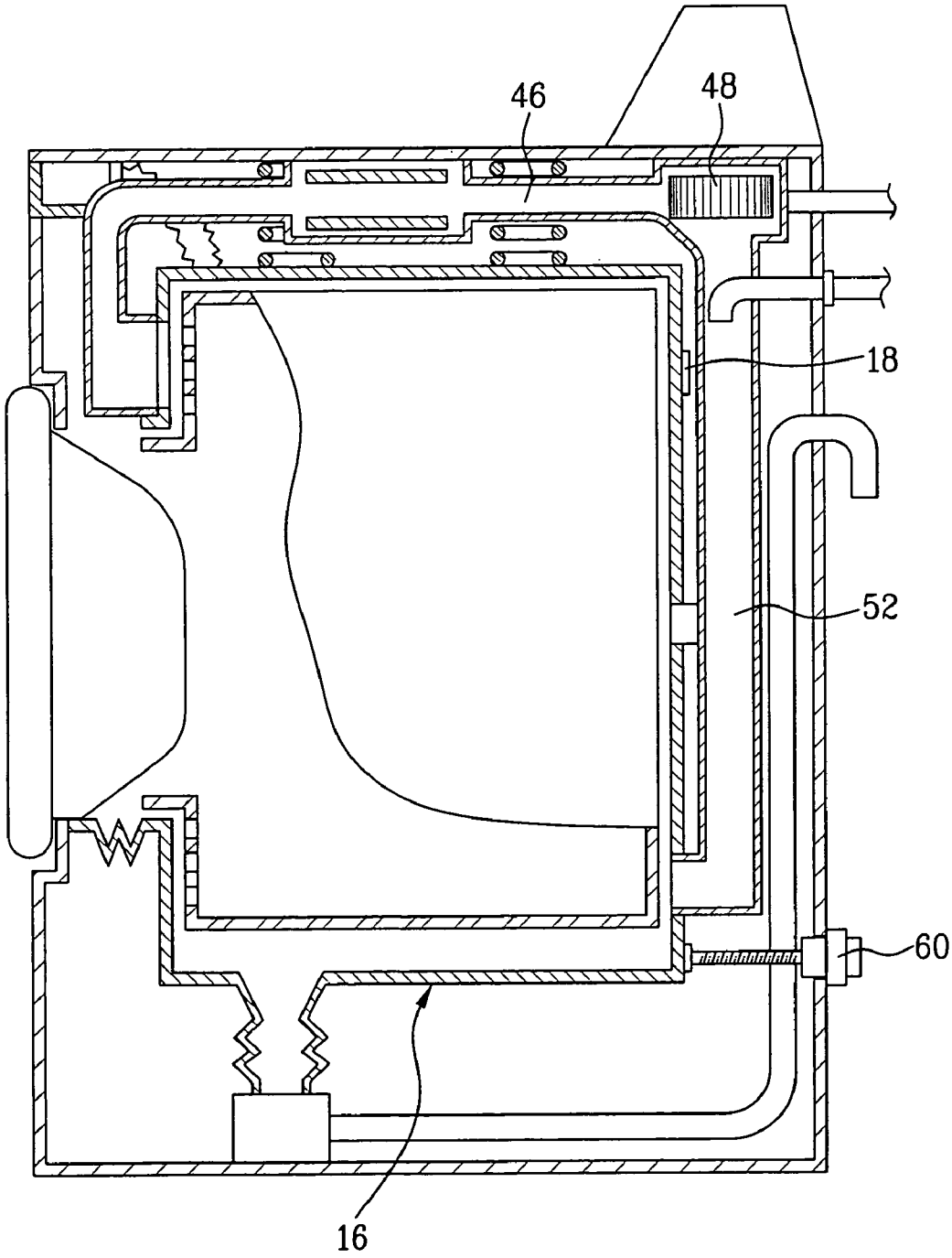
FIG. 2 Related Art
FIG. 2 illustrates a schematic cross sectional view showing a second embodiment of the drum washing machine of the related art.
Figure 3:
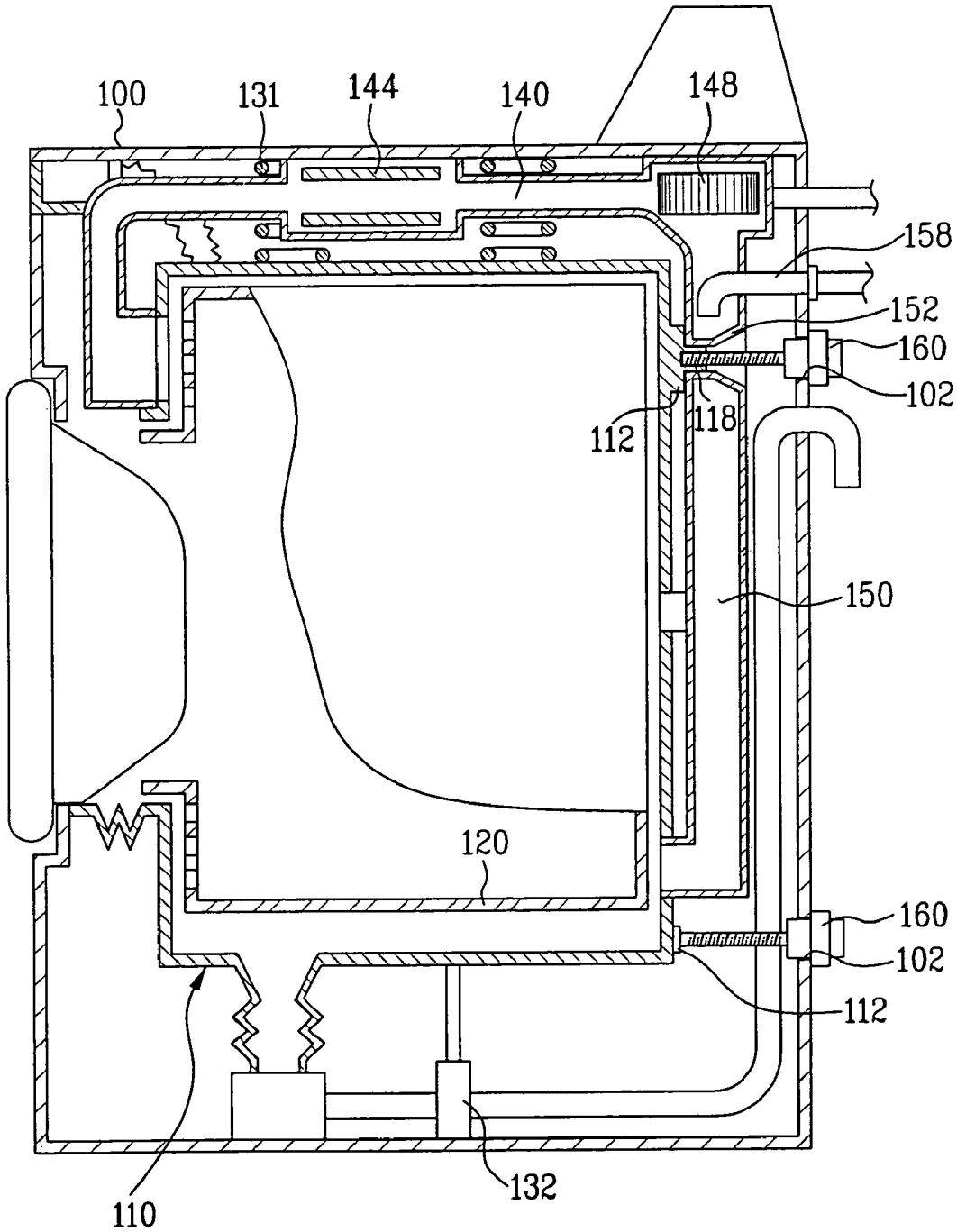
FIG. 3 illustrates a schematic cross sectional view showing a first embodiment of a structure of a drum washing machine in accordance with the present invention.
Figure 4:
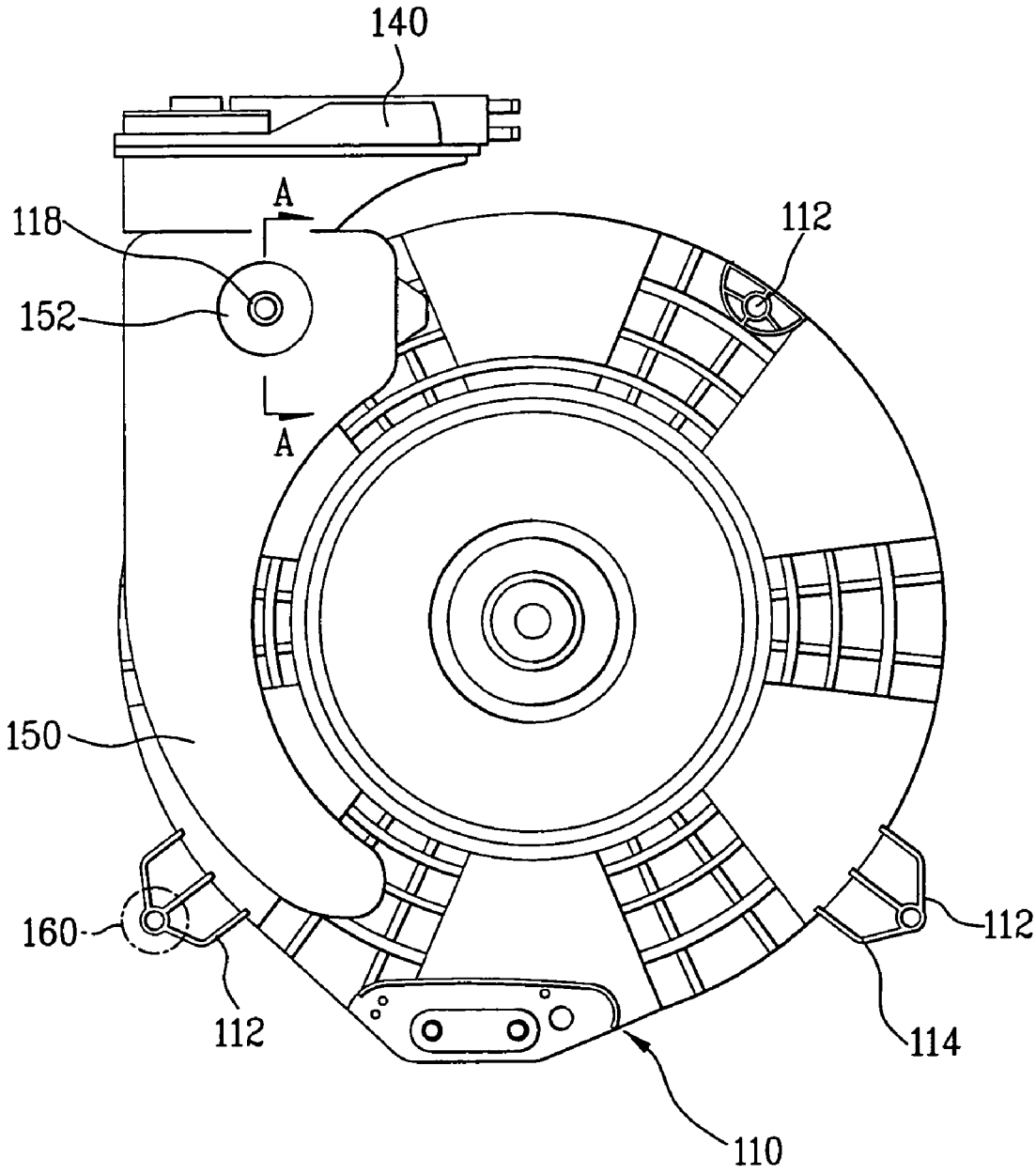
FIG. 4 illustrates a rear view showing a rear structure of a tub of the drum washing machine of FIG. 3.
Figure 5:
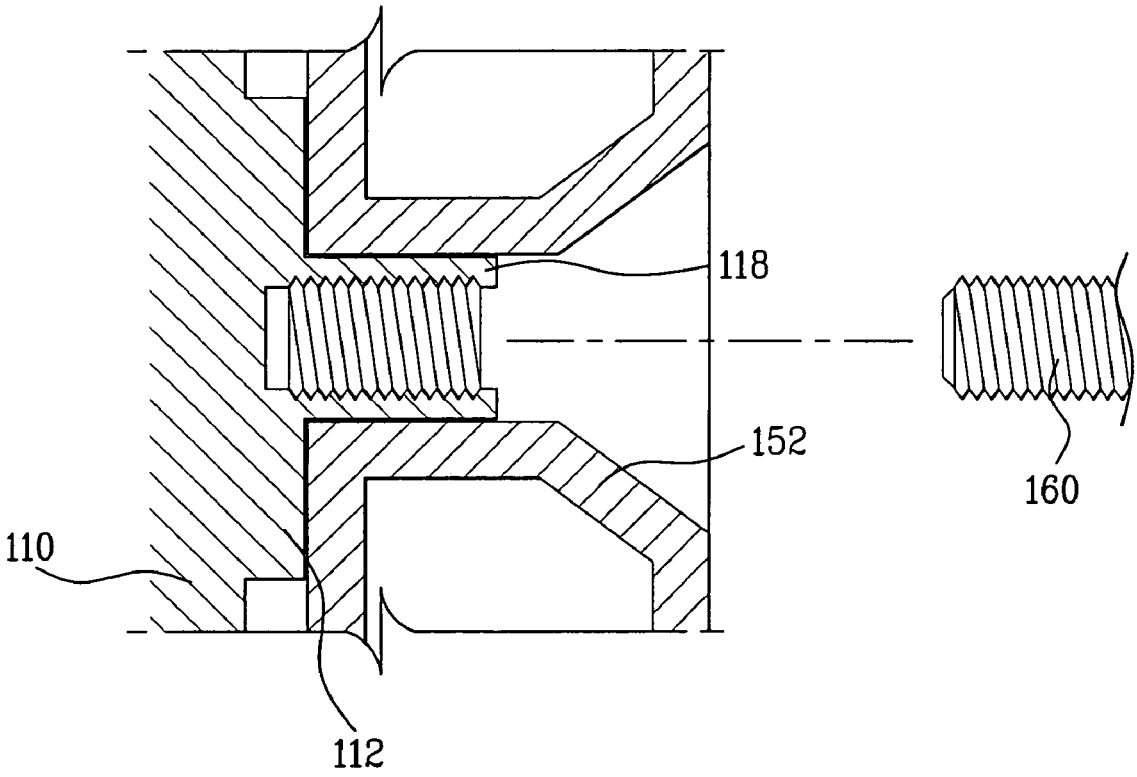
FIG. 5 illustrates a cross sectional view taken along line A-A' of FIG. 4.

Referring to FIGS. 3 to 5, a structure of a drum washing machine of the present invention will be described. As illustrated in FIGS. 3 to 4, a tub 110 for storing wash water is mounted in a cabinet 100, and a drum 120 is rotatably mounted at inside of the tub 110. A motor (not shown) for transmitting a driving force to the drum 120 is mounted at a rear side of the tub 100. An upper end of the tub 100 is supported by a plurality of springs 131 hanging on the cabinet 100, and a lower end thereof is supported by a plurality of dampers 132.

A drying duct 140 is provided at an upper part of the tub 110. A fan 148 and a drying heater 144 are built in the drying duct 140 so as to create and circulate hot air. A first end of the drying duct 140 is communicated with a front portion of the tub 110.

A second end of the drying duct 140 is communicated with a first end of the condensing duct 150. A second end of the condensing duct 150 is communicated with a lower end on the rear surface of the tub 110 so as to form a circulating passage, together with the drying duct 140. A water supplier 158 is mounted at the condensing duct 50 so as to condense humidity from humid air discharged form the tub 110. It is desirable that the condensing duct 150 be mounted to be connected with a rear surface of the tub 110 so as to save a space.

Meanwhile, a plurality of screw coupling members 112 are provided on a rear surface of the tub 110. Each of the plurality of screw coupling members 112 is to be coupled with a transit bolt 160 which will be described later. In order to maintain the center of gravity of the tub 110, it is desirable that each of the plurality of screw coupling members is formed at one position on each of the upper left and upper right sides of a rear surface of the tub 110, and at one position on each of the lower left and lower right sides thereof, thereby at total of 4 positions.

In this case, the screw coupling member 112 formed at a lower part thereof is formed at an end of a rib 114 radially extended toward an outside thereof. The transit bolt 160 is coupled with a screw coupling member 112 of the tub through a coupling hole 120 formed on a rear surface of the cabinet 100. It is desirable that an inner circumferential surface of the screw coupling member 112 is formed in a zigzag form so as to be coupled with a screw.

In this case, at least one of the plurality of screw coupling members 112 is covered with a condensing duct 150. Accordingly, a through hole 152 is formed at the condensing duct 150 so as to be communicated with the screw coupling member 112.

A plurality of coupling holes 102, as many as the number of the screw coupling members 112, are formed at positions corresponding to the screw coupling members, on a rear surface of the cabinet 100 including a rear surface of the drum washing machine.

As illustrated in FIG. 5, the screw coupling member 112 communicating with the through hole 152 of the condensing duct 150 may be formed in the form of a boss 118 protruded rearward from the tub. In this case, it is desirable that an outside entrance of the through hole 152 is tapered toward the outside of the tub 110.

Accordingly, when the condensing duct 150 is conjoined with the tub 110, the through hole 152 is temporarily assembled by being inserted into the boss 118 of the tub 110, and then the assemblage is completed by coupling a bottom end of the condensing duct with the tub 110 and coupling an upper end thereof with the drying duct 140.

The transit bolt is inserted into the coupling hole 102 formed on a rear surface of the cabinet 100 so as to screwed down to the screw coupling member 112 of the tub 110. In this case, the coupling bolt 160 is coupled with the screw coupling member 112 formed at a portion covered by the condensing duct 150 through the though hole 152 of the condensing duct 150. In this case, the transit bolt 160 is more easily coupled with the boss 118 along a slope formed at an entrance of the through hole 152.

Therefore, since the transit bolt 160 is coupled with the tub 110 and the tub 110 is fixed on a rear surface of the cabinet 100, the tub 110 is immovable even if an impact is applied to a washing machine during transportation.

As examined above, the transit bolt coupling structure of the drum washing machine has following effects.

First, even though a condensing duct is provided on a rear surface of a tub, a transit bolt can be coupled while maintaining the weight of gravity of the tub.

In other words, since the transit bolt for fixing the tub on the cabinet can be coupled without changing a position of a coupling member of an existing tub, the existing coupling members dispersed for supporting the weight of the tub kept in equilibrium are maintained at same positions.

Second, when the condensing duct is assembled to a rear wall of the tub, the tub can be temporary assembled first and completely assembled. Therefore, convenience of assemblage is increased.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum washing machine having tub coupling structure comprising:

a cabinet having a plurality of coupling holes each receiving a transit bolt on a rear surface thereof;

a tub provided in the cabinet so as to store wash water therein;

a plurality of coupling members formed in a rear surface of the tub so as to be coupled with the transit bolt;

a condensing duct provided to be connected with a rear surface of the tub and having a through hole formed at a position corresponding to one of the coupling members of the tub so as to be communicated therewith, the through hole to which the transit bolt is inserted; and a boss protruded from the rear surface of the tub communicating with the through hole so as to be inserted into the through hole and coupled with the transit bolt passed through the through hole.

2. The drum washing machine having tub coupling structure of claim 1, wherein the through hole of the condensing duct comprises an entrance formed on a rear side of the condensing duct and is of longitudinal trapezoidal cross-section.

3. The drum washing machine having tub coupling structure of claim 2, wherein a tapered portion of the through hole guides the transit bolt into the through hole as the transit bolt enters the through hole.

4. The drum washing machine having tub coupling structure of claim 2, wherein the through hole is tapered in the direction of the tub from the entrance on the rear side of the condensing duct.

5. The drum washing machine of claim 1, wherein the tub comprises a rib radially extended toward an outside the tub, the rib including one of the coupling members.

6. A drum washing machine comprising:

a cabinet having a plurality of coupling holes each receiving a transit bolt on a rear surface thereof;

a tub provided in the cabinet so as to store wash water therein and having a plurality of coupling members each coupled with the transit bolt on a rear surface thereof;

at least one spring provided at an upper part of the tub and attached to the cabinet, and a damper provided at a lower part of the tub, wherein the tub is supported by the spring and the damper and is movable in a limited range determined by the spring and the damper to reduce vibration during washing; and a condensing duct provided to be connected with a rear surface of the tub, the condensing duct having a through hole formed at a position corresponding to one of the coupling members of the tub so as to be communicated therewith, the transit bolt being inserted in the through hole.

7. The drum washing machine of claim 6, further comprising a boss protruded from the coupling member communicating with the through hole so as to be inserted into the through hole and coupled with a transit bolt passed through the through hole.

8. The drum washing machine of claim 6, wherein the through hole of the condensing duct comprises an entrance formed on a rear side of the condensing duct and tapered toward the outside of the tub, wherein the through hole is tapered in the direction of the tub from the entrance on the rear side of the condensing duct.

9. drum washing machine of claim 8, wherein a tapered portion of the through hole guides the transit bolt into the through hole as the transit bolt enters the through hole.

10. The drum washing machine of claim 6, wherein the tub comprises a rib radially extended toward an outside the tub, the rib including one of the coupling members.

* * * * *